US007044509B2

(12) United States Patent
Radel

(10) Patent No.: US 7,044,509 B2
(45) Date of Patent: May 16, 2006

(54) CLOSURE LATCH ASSEMBLY

(76) Inventor: Michael B. Radel, 12420 Ventura Blvd., Studio City, CA (US) 91604

( * ) Notice: Subject to any disclaimer, the term of this patent is extended or adjusted under 35 U.S.C. 154(b) by 0 days.

(21) Appl. No.: 10/708,456

(22) Filed: Mar. 4, 2004

(65) Prior Publication Data

US 2005/0194797 A1 Sep. 8, 2005

(51) Int. Cl.
*E05C 19/06* (2006.01)

(52) U.S. Cl. ..... 292/91; 292/32; 292/41; 292/106; 292/147; 292/150; 292/302; 292/337; 292/340; 292/341.15; 292/DIG. 37; 49/394

(58) Field of Classification Search ..... 292/91, 292/32, 41, 106, 121, 137, 145, 147, 150, 292/162, 302, 337, 340, 341.15, DIG. 37, 292/151; 49/394
See application file for complete search history.

(56) References Cited

U.S. PATENT DOCUMENTS

| | | | | | |
|---|---|---|---|---|---|
| 15,094 | A * | 6/1856 | Warner | 292/145 |
| 108,361 | A * | 10/1870 | Kent | 292/341.15 |
| 116,646 | A * | 7/1871 | Van | 292/162 |
| 257,141 | A * | 4/1882 | Purves | 292/57 |
| 258,833 | A * | 5/1882 | White | 70/429 |
| 271,001 | A * | 1/1883 | Thompson | 292/180 |
| 476,159 | A * | 5/1892 | Muller | 292/341.15 |
| 1,156,707 | A * | 10/1915 | Pacelli | 292/86 |
| 1,317,092 | A * | 9/1919 | Maurer | 292/148 |
| 1,574,222 | A * | 2/1926 | Wensel | 292/152 |
| 2,098,569 | A * | 11/1937 | Curtis | 292/42 |
| 3,591,219 | A * | 7/1971 | Graziosi | 292/207 |
| 3,799,593 | A * | 3/1974 | Dielman | 292/145 |
| 4,021,063 | A * | 5/1977 | Porter | 292/67 |
| 4,161,870 | A * | 7/1979 | Barnes | 70/278.7 |
| 4,179,143 | A * | 12/1979 | Shy | 292/179 |
| 4,214,783 | A * | 7/1980 | Boegeman | 292/150 |
| 4,673,202 | A * | 6/1987 | Willis | 292/162 |
| 4,744,392 | A * | 5/1988 | Tade et al. | 138/89 |
| 4,746,152 | A * | 5/1988 | Willcox | 292/150 |
| 4,759,575 | A * | 7/1988 | McKnight | 292/144 |
| 4,767,139 | A * | 8/1988 | Hansing | 292/162 |
| 4,784,415 | A * | 11/1988 | Malaval | 292/144 |
| 5,511,835 | A * | 4/1996 | Hardee | 292/238 |
| 5,588,318 | A * | 12/1996 | Osborne | 70/469 |
| 5,603,184 | A * | 2/1997 | Campbell et al. | 49/394 |
| 5,799,990 | A * | 9/1998 | Hardee | 292/238 |
| 6,808,212 | B1 * | 10/2004 | Hardee | 292/150 |
| 2003/0201649 | A1 | 10/2003 | Christensen | 292/339 |

* cited by examiner

*Primary Examiner*—Brian E. Glessner
*Assistant Examiner*—Carlos Lugo
(74) *Attorney, Agent, or Firm*—Kyle W. Rost

(57) ABSTRACT

An elongated latch bar is slidably carried in a passageway through a bolt housing and is extendable into an aligned passageway of a keeper. The extended end of the latch bar carries a transverse cavity for receiving a cross-latch. The keeper carries the cross-latch in a suitable position to engage and lock the latch bar to the keeper when the latch bar when it is suitably inserted and positioned in the keeper. The cross-latch carries narrow operator that extends across the keeper passageway to an outside location and allows the cross-latch to be manually depressed. The latch bar has a forked end that creates a slot leading to the cavity. The slot is sized to allow passage of the operator but not the cross-latch.

6 Claims, 8 Drawing Sheets

CLOSURE LATCH ASSEMBLY

BACKGROUND OF INVENTION

1. Field of the Invention

The invention generally relates to closure fasteners and especially to the type employing a bolt. In another aspect, the invention relates to closure fasteners in which a bolt also serves as a brace. A closure fastener provides a child-resistant feature and can be applied to folding door sets, double door sets, sliding doors, single pivot doors, drawers, and many other types of closures.

2. Background Art

Latch assemblies can be applied to secure many styles of doors and other closures. A barrel bolt is an example of a latch assembly that is often added to a door, to operate between the side of a door and the doorframe. The barrel bolt provides an elongated, round bolt carried in the bore of a cylindrical bolt housing, usually mounted on a door. An operator arm extends from the side of the bolt and through a slot in the housing. The operator can extend and retract the bolt in the housing and rotate with the bolt to lodge the operator in any of various notches in the side of the slot, thus fixing the bolt in a stationary position. A keeper is mounted in alignment with the bolt path, typically on the doorframe, and receives the extended end of the bolt to lock the door to the frame.

In terms of being child-resistant, barrel bolts have the disadvantage of operating by the single operating lever to perform all functions. This operating routine is so simple that a small child can accomplish it. Thus, the simplicity of a barrel bolt causes it to be unsuited for use as a child-resistant latch.

Other types of child-resistant latches are known. A variety of latch designs are necessary to match various latch characteristics to the style of each door. A door or a set of doors that move to open or close in the plane of the door requires a special latch design. Examples of such doors include folding doors sets and sliding doors, which often are used as closet doors or fireplace doors. Many conventional latches are not useful because the doors draw away from each other or from the doorframe in the plane of the bolt, thus extracting the bolt from the keeper by movement of the door, itself. Special types of latches can be used in these situations, such a top bolts or floor bolts, or the side latch can be a hook.

Adding a child-resistant latch to certain doors can be difficult if the door is not designed to accommodate a latch. For example, the material of a glass door cannot be drilled to attach a lock. Certain designs of sliding doors are constructed of a thin panel in a small frame and lack sufficient thickness or frame size to receive an added lock. A metal door might be overly damaged by the addition of screws. If a child-resistant latch is to be attached to these types of doors, it may require an adhesive base.

It would be desirable to have a latch that can be applied to substantially any type of style of closure.

The issue of securing all types of closures commonly arises in family life when a child is present. Keeping all types of doors closed and locked becomes important for safety of the child. Houses, fixtures, and furnishings can present an unknown variety of closure types and designs. A variety of specialized and unique locks may be available to accommodate each individual type of closure found in a home. However, the adult residents may face a frustratingly large variety of different lock designs and operating methods within a single home. The inconvenience of this situation discourages the wide use of child-resistant fasteners. Suppliers and installers of child-resistant latches face the related difficulty of providing a sufficient variety of locks to accommodate all closures.

Consequently, it would be desirable for one type of operating mechanism in a child-resistant latch to be broadly effective with the many types of closures found in a residence. The adult residents will find a single mechanism far more acceptable for widespread installation and regular use. Also, the supplier and installer of child-resistant fasteners may expect better acceptance of the product.

Among child-resistant locks and latches especially suited for sets of folding doors, U.S. Patent Application Publication No. 2003/0201649 to Christensen is a recent example. A pair of bars is joined at an adjustable gap by screws or bolts. In use, the bars extending across the several doors of a set, clamping door handles between the bars. Thus, the doors no longer can open either by folding or sliding apart. This solution may be effective but is of limited application and utility. Sandwiching the door handles requires tightening screws or bolts, making the lock a semi-permanent solution. Employing such a device on doors of a seldom-used fireplace may be acceptable, while closing off more frequently used doors may not. Thus, the need continues for a reliable and readily operated latch that is suited for use with sliding and folding doors, as well as other types of doors.

To achieve the foregoing and other objects and in accordance with the purpose of the present invention, as embodied and broadly described herein, the method and apparatus of this invention may comprise the following.

SUMMARY OF INVENTION

The invention is an improvement in latch assembly formed of a bolt housing carrying a longitudinally elongated latch bar, partially retained within a passageway of the bolt housing. The latch bar is longitudinally extendable from the bolt housing. A keeper has a reception passage for receiving an extending free end of the latch bar. Thus, the free end of the latch bar is extendable from the bolt housing into the keeper, establishing a latching relationship with the keeper. Against this background, the improvement is that the free end of the latch bar is configured with a cavity on its lateral side. The keeper carries a cross-latch that moves on a transverse axis to the keeper reception passage. The cross-latch moves between positions of greater and lesser intersection with the reception passage. A resilient device biases the cross-latch to move toward a position of greater intersection with the reception passage. An operator is connected to the cross-latch for selectively retracting the cross-latch against the force of the resilient device, to a position of lesser intersection with the reception passage. The cavity and the cross-latch can be arranged in coordinated positions such that the cross-latch and cavity are mutually engaged when the cross-latch is in the position of greater intersection with the reception passage. In the coordinated positions, the free end of the latch bar has been sufficiently inserted into the reception passage. In this position, the cross-latch can lock the latch bar to the keeper. The cross-latch and cavity can be mutually disengaged when the cross-latch is in the position of lesser intersection with the reception passage. In this latter position, the latch bar is allowed to be inserted into or removed from the reception passage.

According to another aspect of the invention, a child-resistant latch assembly is suited for securing a closure element. A longitudinally elongated latch bolt carries a plunger reception cavity formed sideways in the bolt. A bolt housing carries the bolt in a sliding relationship in a latch bolt passageway. An end of the bolt is extendable from the bolt housing to latch a closure. A keeper has a longitudinal reception passage that can be placed in alignment with the latch bolt passageway of the bolt housing. The reception passage selectively receives the extended end of the latch bolt. The keeper carries a resiliently biased plunger in a position where the plunger can intersect the reception passage. When the latch bolt is suitably positioned in the reception passage, the plunger can enter the plunger reception cavity in the latch bolt to lock the latch bolt to the keeper.

Thus, the plunger selectively locks and unlocks the latch bolt to the keeper by selectively engaging and disengaging the plunger reception cavity.

The accompanying drawings, which are incorporated in and form a part of the specification, illustrate preferred embodiments of the present invention, and together with the description, serve to explain the principles of the invention. In the drawings:

DETAILED DESCRIPTION

Figure 1:
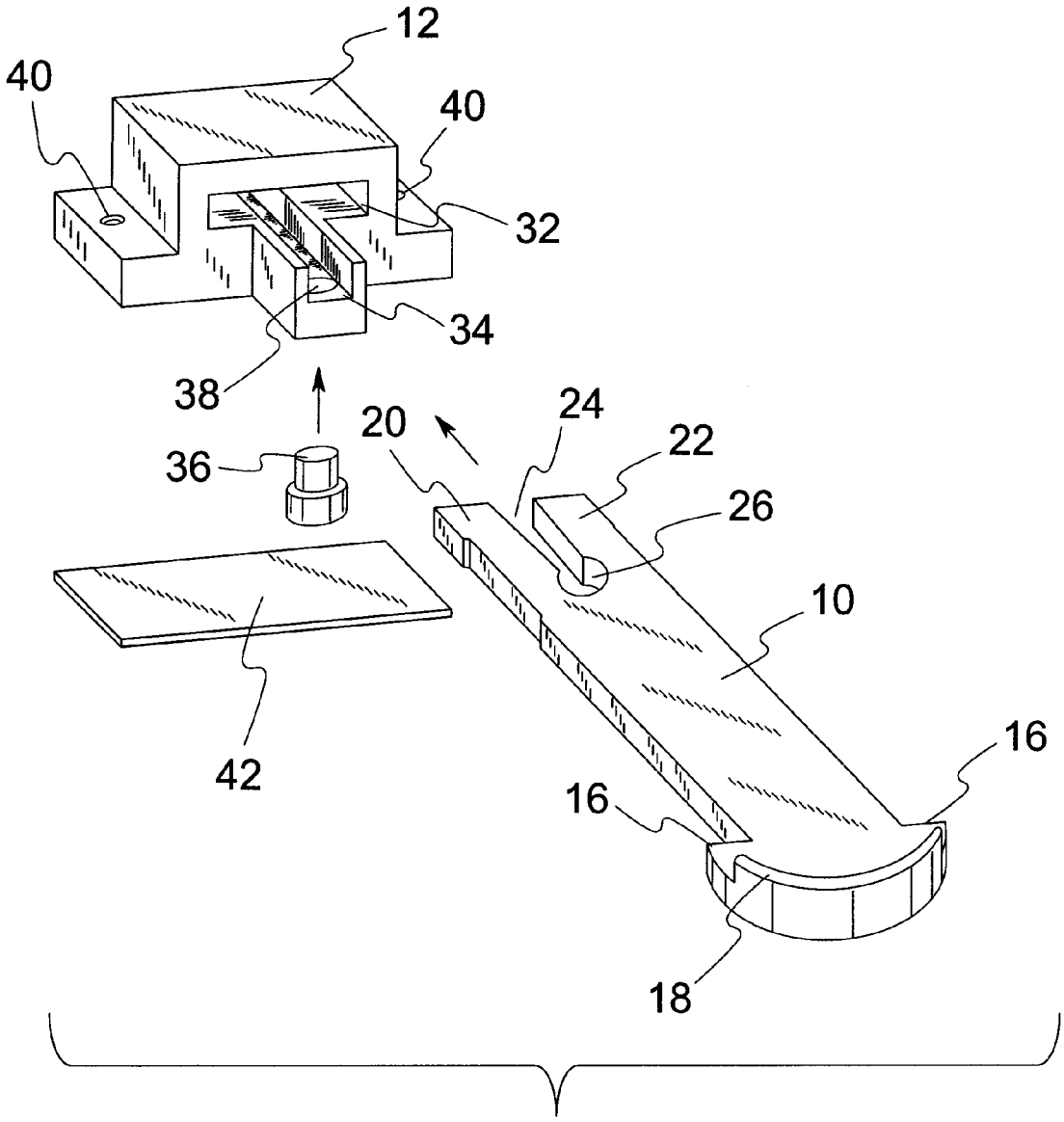
FIG. 1 is an isometric assembly view of a bolt housing and bolt according to one embodiment of the invention.

The invention provides a latch assembly that is adaptable to secure a broad variety of closure elements such as sliding doors, pocket doors, by-pass doors, side swinging doors, folding doors, sets of multiple doors in any configuration, cabinet doors, drawers, and others. This is achieved by providing a longitudinally elongated latch bar 10 that is contained by a first end in a bolt housing 12. In addition, the latch bar can be moved longitudinally through a passageway in the bolt housing 12 to extend the second and opposite end of the latch bar 10 for insertion into an aligned passageway into a keeper 14. The extended end of the latch bar carries a transverse recess such as a groove, a bore, a notch, or like structure, formed in a side of the latch bar. The keeper carries a cross-latch, such as a locking pin or plunger head 16, that can be moved into transverse engagement with the recess of the latch bar 10 when the latch bar is suitably inserted and positioned in the keeper. As a result, the latch bar 10 is secured to both the bolt housing and to the keeper and cannot be accidentally withdrawn from either, regardless of the direction of force.

The latch bar 10 can be of any selected length, allowing the bolt housing 12 and keeper 14 to be separated by any selected distance. Thus, with a large spacing between the bolt housing 12 and keeper 14, the shank of the latch bar 10 may be substantially exposed and can serve as a brace between the two anchoring devices. The brace may function usefully to hold folding doors in a flat, closed plane. With a smaller spacing, the bolt housing 12 and keeper 14 may be substantially adjacent, and the latch bar 10 may be exposed through only a minimal distance.

The latch bar 10 is limited in separation from the bolt housing 12 by a stop at the first end of the latch bar 10, which is positioned to allow excess bar length to protrude from the bolt housing 12 opposite from the keeper 14. Thus, the effective length of the latch bar between the bolt housing 12 and keeper 14 is a flexible variable and does not limit the installed closeness of the bolt housing 12 and keeper 14 except as to the maximum extension of the second end of the latch bar from the bolt housing 12.

The drawings show a preferred embodiment in which similar numbers refer to parts of similar function. Terms such as "latch bar," "bolt," or "slide bolt" refer to an elongated member of any profile, whether square, rectangular, round, or some other profile. Such a latch member functions by crossing the interface between a closure element and juxtaposed structure to provide a latching link. "Bolt housing" refers to a housing that carries a latch bar or bolt in an elongated passageway or slideway, such that the latch bar or bolt can be drawn between extended and retracted positions from one or both ends of the bolt housing. A bolt housing serves as a first anchoring structure, fastened on one side of the interface to hold a first end of a latch bar. "Keeper" refers to a reception housing that receives the extended end of a bolt or latch bar in a receiving passageway. A keeper is mounted on the opposite side of the interface from the bolt housing to receive the extended end of a latch bolt, thereby providing a second anchoring structure holding the second end of the latch bar.

Figure 2:
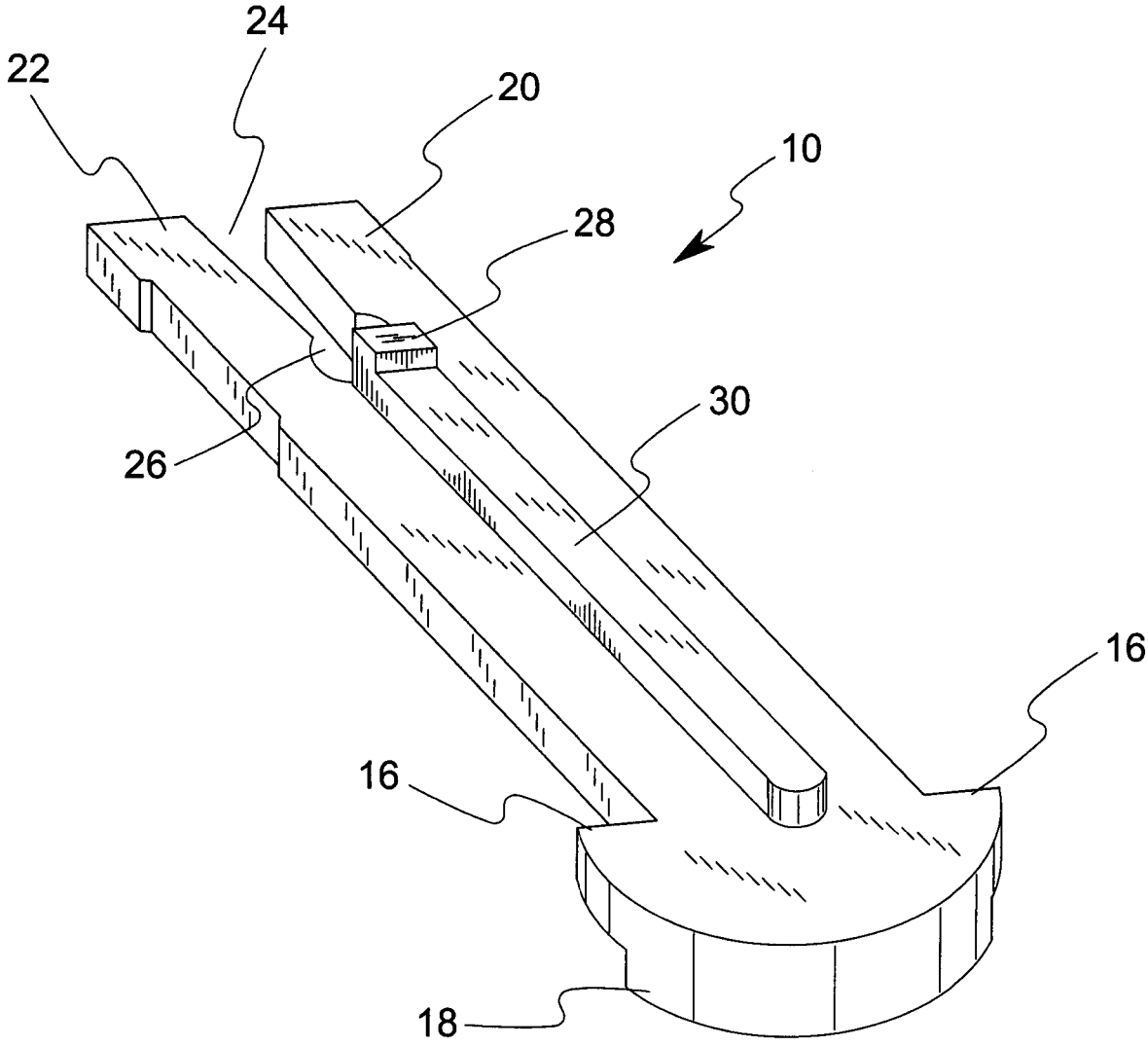
FIG. 2 is an isometric view of an opposite face of the bolt shown in FIG. 1.

FIGS. 1 and 2 show a latch bar or slide bolt 10 configured as a slide plate of generally rectangular transverse profile. The first end of the slide plate 10 is configured to carry a stop, such that it cannot fully pass through the bolt housing 12. Thus, the first end defines a pair of stop shoulders 16, one at each side edge of the slide plate 10. The stop shoulders 16 are located on a portion of the slide plate that extends longitudinally out of the bolt housing, on the end opposite from the keeper. The slide plate is free to pass through the bolt housing 12 to any degree until the stop shoulders 16 strike the housing 12.

As a matter of convenience, the first end of the slide plate is configured in an arc. From the top major face of the slide plate 10 as shown in FIG. 1, an arcuate rib 18 extends upwardly and provides a finger engagement for withdrawing the slide plate 10. The finger engagement rib 18 is at least partially offset, longitudinally set back toward first the first end of the slide plate with respect to stop shoulders 16, which ensures that a finger spacing is present between the rib 18 and the bolt housing 12 regardless of how far the slide plate is extended through the bolt housing.

The second and opposite end of the slide plate 10 is insertable through the bolt housing 12 to any degree until limited by contact between the stop shoulders 16 the bolt housing. The second end of the bolt is forked, split, or otherwise double-tongued to define laterally separated end portions 20 and 22. Between themselves, the end portions 22 and 22 define an entrance slot 24. The slot has a broad mouth at the second end of the slide plate 10, tapering with increasing distance from the broad mouth. Slot 24 communicates with and leads into transverse recess or other lock cavity 26, which may be configured as an annular slot, a notch, an aperture of any profile, and preferably as a circular aperture through the major faces of slide plate 10. The diameter or other transverse dimension of the lock cavity is broader than the width of slot 24 immediately at the interface with the lock cavity. Thus, a cross-latch such as a pin or plunger can be inserted into the lock cavity from a major face of the slide plate 10. The pin may be of similar transverse dimension to the lock cavity, with the result that the pin is not removable through the slot 24.

With reference to the inverted view of the latch bar in FIG. 2, optionally the slide plate carries a second end stop 28, which also may be referred to as the keeper end stop, near the second end thereof. In the particular embodiment shown, the slide plate 10 also carries an optional guide rib 30 extending from a major face of the slide plate, which may be referred to as the bottom face. The second end stop 28 is shown to be positioned at an end of rib 30 immediately adjacent to lock cavity 26.

With further reference to FIG. 1, the bolt housing 12 defines and contains a passageway 32 configured to receive slide plate 10 in a linear sliding relationship. The transverse configuration of the passageway is similar to the transverse configuration of the slide plate 10, shown as a thin and broad plate of rectangular profile. In addition, the floor of the passageway 32 further and optionally defines a bottom channel 34 configured to receive the rib 30 in sliding relationship. The channel 34 is deeper than the height of rib 30. The base wall of the channel is at a suitable depth to allow passage of the second end stop 28. Therefore, the broad, major top and bottom faces of the slide plate 10 typically ride against corresponding major support surfaces of the passageway 32, while the rib 30 provides only lateral guidance against the side walls of channel 34.

The channel 34 in the bolt housing 12 provides a convenient location to place a second end stop, shown in FIG. 1 as a cylindrical boss 36 that is inserted into a reception bore 38 in the bolt housing 12. The reception bore 38 communicates with the channel 34 and allows boss 36 to be placed where it will occupy a sufficient height in the channel to interfere with passage of the second end stop 28. Friction, adhesive, welding, or any other method or means can permanently install boss 36.

During initial assembly of the slide plate 10 into bolt housing 12, the second end of the slide plate in inserted into the passageway 32 until the second end stop 28 has advanced past reception bore 38. The boss 36 then is installed into the bore 38, with the result that the slide plate 10 cannot be withdrawn from the passageway 32. Interference between the second end stop 28 and boss 36 prevents the slide plate 10 from being withdrawn from the bolt housing 12 in the direction of the first end of the slide plate. Interference between the bolt housing 12 and stop shoulders 16 prevents the slide plate from being withdrawn from the bolt housing in the direction of the second end of the slid plate. Thus, the slide plate 10 is slidable through the bolt housing 12 for a considerable distance, according to the length of the bolt housing and the length of the slide plate between stop 28 and stop shoulders 16. At the same time, the slide plate 10 is nonremovable from the bolt housing for so long as boss 36 remains installed.

Other details shown in FIG. 1 include various means for mounting the bolt housing 12 on a closure element or stationary frame. One mounting means is a pair of mounting holes 40 allowing passage of a fastener through the bolt housing and into a suitable underlying surface. Screws, nails, rivets, clips, staples, and the like, or other fasteners can be used. Another mounting means is a base sheet 42, which may be a double-sided adhesive sheet that attaches to a base of the bolt housing 12 and is attachable to a closure element or frame to mount the bolt housing 12. Between these mounting possibilities, the bolt housing can be attached to substantially any supporting surface.

Figure 3:
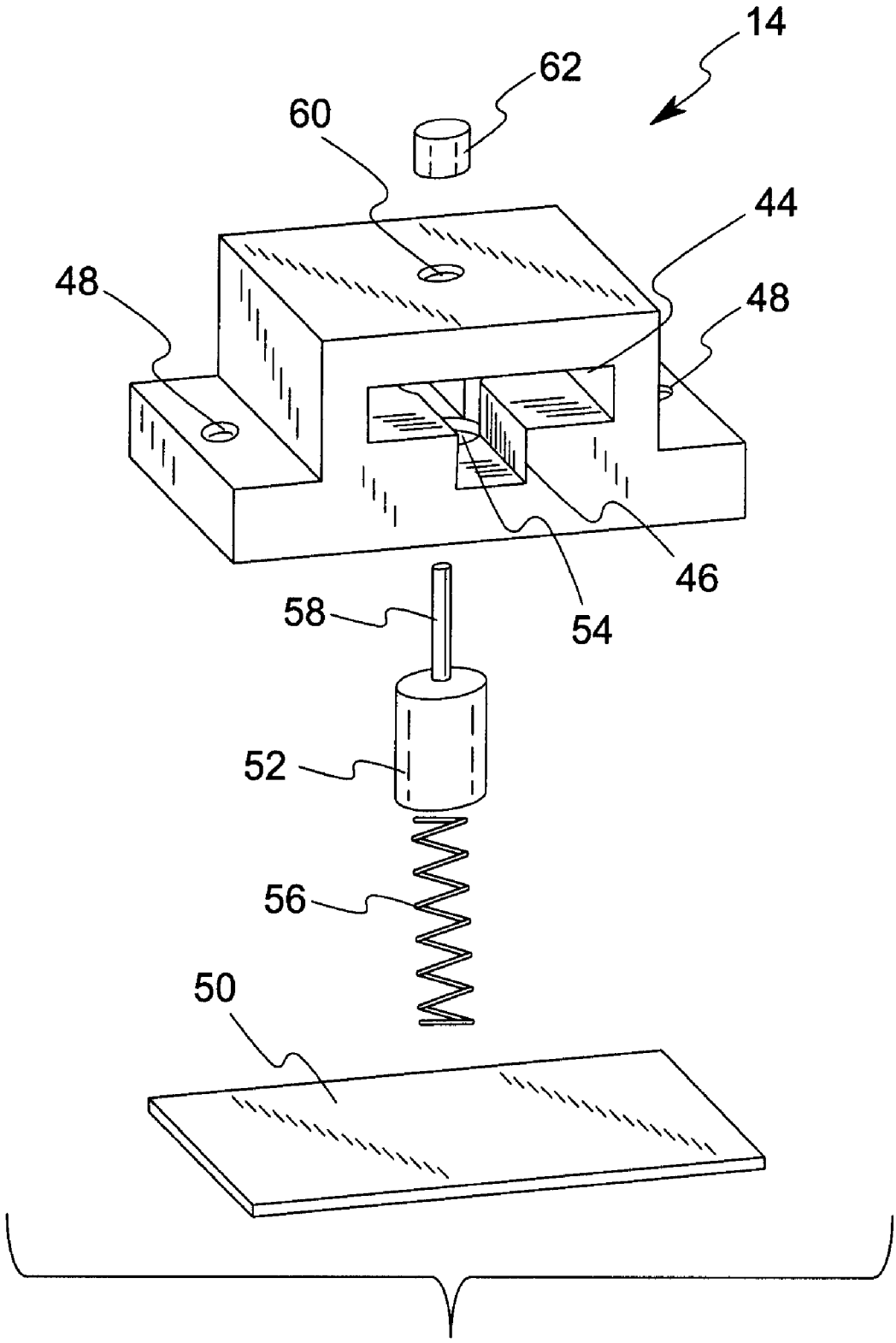
FIG. 3 is an isometric assembly view of a keeper according to one embodiment of the invention.

The keeper 14, best shown in FIG. 3, provides a housing defining a longitudinal reception passage, bore, or other passageway 44, which may be configured similarly to passageway 32, for receiving the second end of slide plate 10. An optional channel 46 for receiving rib 30 may extend parallel to passage 44 in open communication through a wall of passage 44. Likewise, the keeper housing 14 can be equipped with mounting means such as fastener holes 48 and a base sheet 50 carrying double sided adhesive, allowing the keeper 14 to be mounted with the same broad possibilities as the bolt housing.

The keeper 14 carries a plunger head 52 in a suitable transverse bore 54 allowing the plunger head to enter the passageway 44 in an intersecting position, whereby the plunger head will interfere with free passage of the slide plate 10. A resilient means such as compression spring 56 applies a biasing force to the plunger head 52, urging the plunger head into a position of relatively greater intrusion or intersection with the passageway 44. The plunger head 52 may have in open bottom end and internal chamber, shown in phantom in FIG. 3, for partially receiving and housing spring 56. The bottom face of the keeper may receive the plunger head in a suitable bore 54 extending through the channel 46 and passageway 44. Base sheet 50 may close the bottom of bore 54 and retain the plunger head 52 and spring 56 in the bore.

The plunger head 56 is connected to an operator 58 for manually moving the plunger head 52 in opposition to the force of resilient spring 56. A suitable operator 58 is a shaft of smaller width or diameter than plunger head 52, symmetrically attached to the plunger head opposite from spring 56. The top wall of the keeper housing 14 provides a narrow top bore 60 for receiving and passing narrow shaft 58. At the same time, the plunger head is stopped by the top wall of keeper 14 from passing beyond the passageway 44. Operator shaft 58 extends beyond the top of keeper 14 and may be capped outside of keeper housing 14 by button 62 for convenient finger engagement.

Therefore, the plunger head is moveable between at least two positions with respect to the reception passage 44. In a position of relatively greater insertion and intersection with the passage 44, the plunger head 52 may be transversely interposed into or across passage 44 for substantially the full height of the passageway 44. The resilient spring 56 biases the plunger head into this position of relatively greater intersection with the passage 44. The second position is achieved when button 62 is manually depressed to correspondingly depress the plunger head via movement of shaft 58. The plunger head 52 can be depressed until it is substantially removed from the passage 44, although it is preferred to remain in a crossing relationship with respect to channel 46, to any degree. Thus, in the second position the plunger head 52 will not interfere with entry and movement of the slide plate 10 in the passage 44, although the plunger head serves as a means for stopping the keeper end stop or second end stop 28 in channel 46 at a position with cavity 26 exactly in alignment with plunger head 52.

Figure 4:
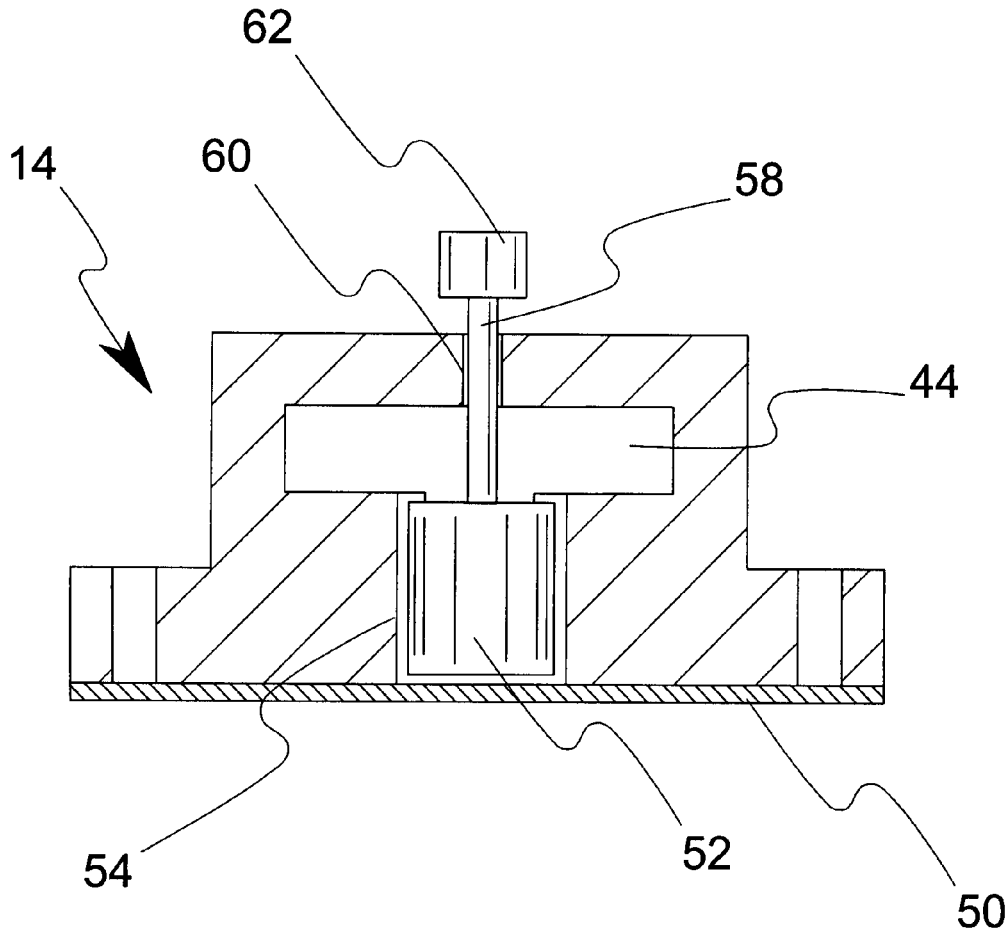
FIG. 4 is a vertical cross-sectional end view of the keeper, showing the plunger positioned to receive the bolt.
Figure 5:
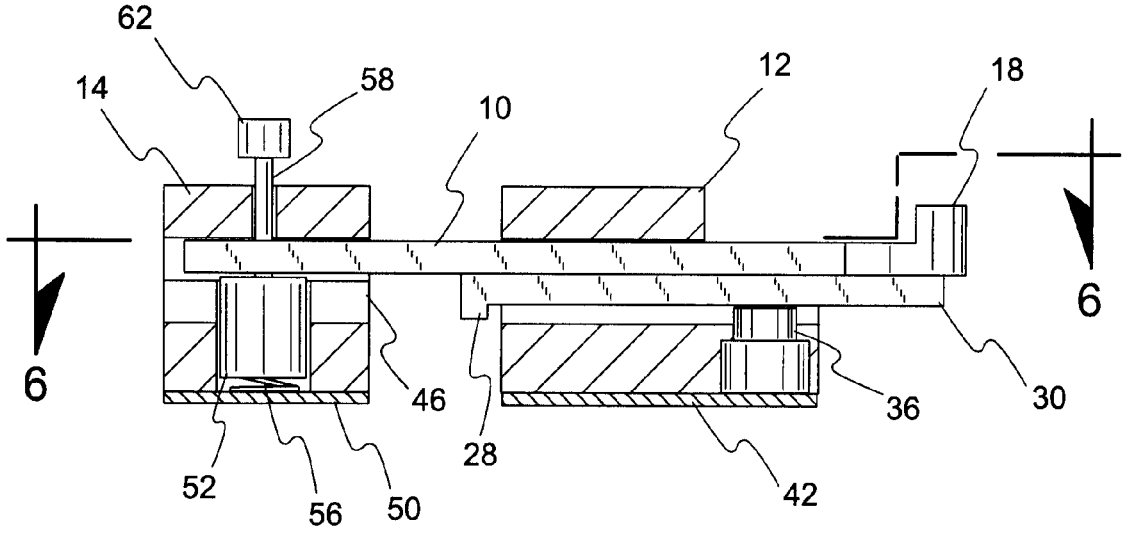
FIG. 5 is a cross-sectional side view of the bolt housing, and keeper, showing the bolt at an entry position.
Figure 6:
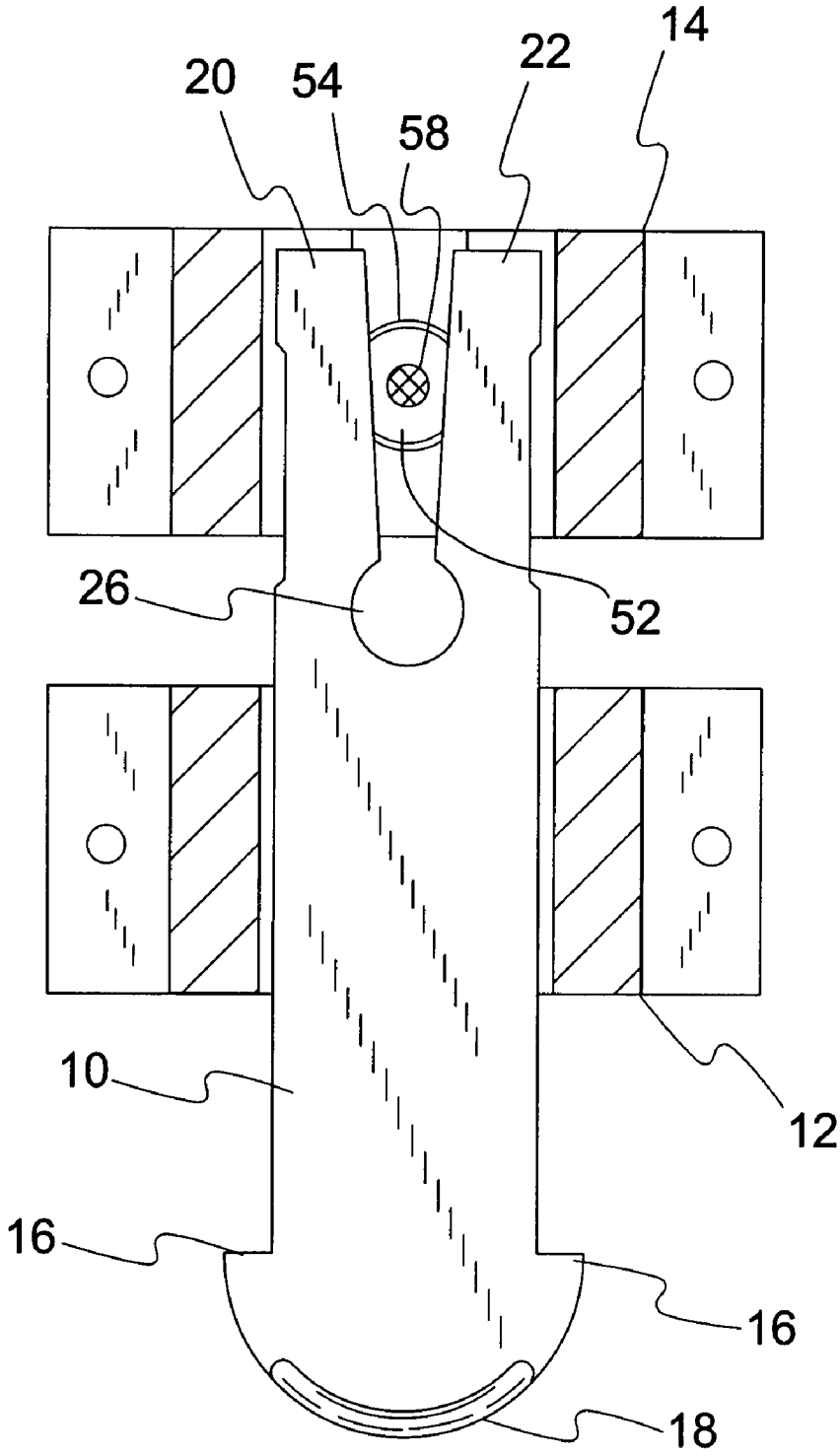
FIG. 6 is a cross-sectional top view showing the bolt at an entry position as in FIG. 5, taken along the plane of line 6—6 of FIG. 5.

FIGS. 4–6 illustrate the preliminary operation of the latch assembly. FIG. 4 shows a preliminary position of the plunger head 52 in keeper 14. Button 62 acts through shaft 58 to depress the plunger head 52 to a position where it is absent from passageway 44 but resides in and transversely crosses channel 46. The slide plate 10 can be inserted into the passageway 44 until stop 28, moving in channel 46, strikes the plunger head 52.

FIGS. 5 and 6 show that the split second ends 20, 22 of the slide plate can enter the keeper and flank shaft 58. The narrow shaft 58 moves through the slot 24 and permits the slide plate 10 to further advance into the keeper. However, the slide plate can advance no further when stop 28 strikes plunger head 52. At that position, the slide plate 10 is inserted into the keeper in the position of FIG. 7. Cavity 26 is positioned in alignment with bores 54 and 60 such that plunger head 52 can rise into cavity 26 if pressure on button 62 is released.

Figure 7:
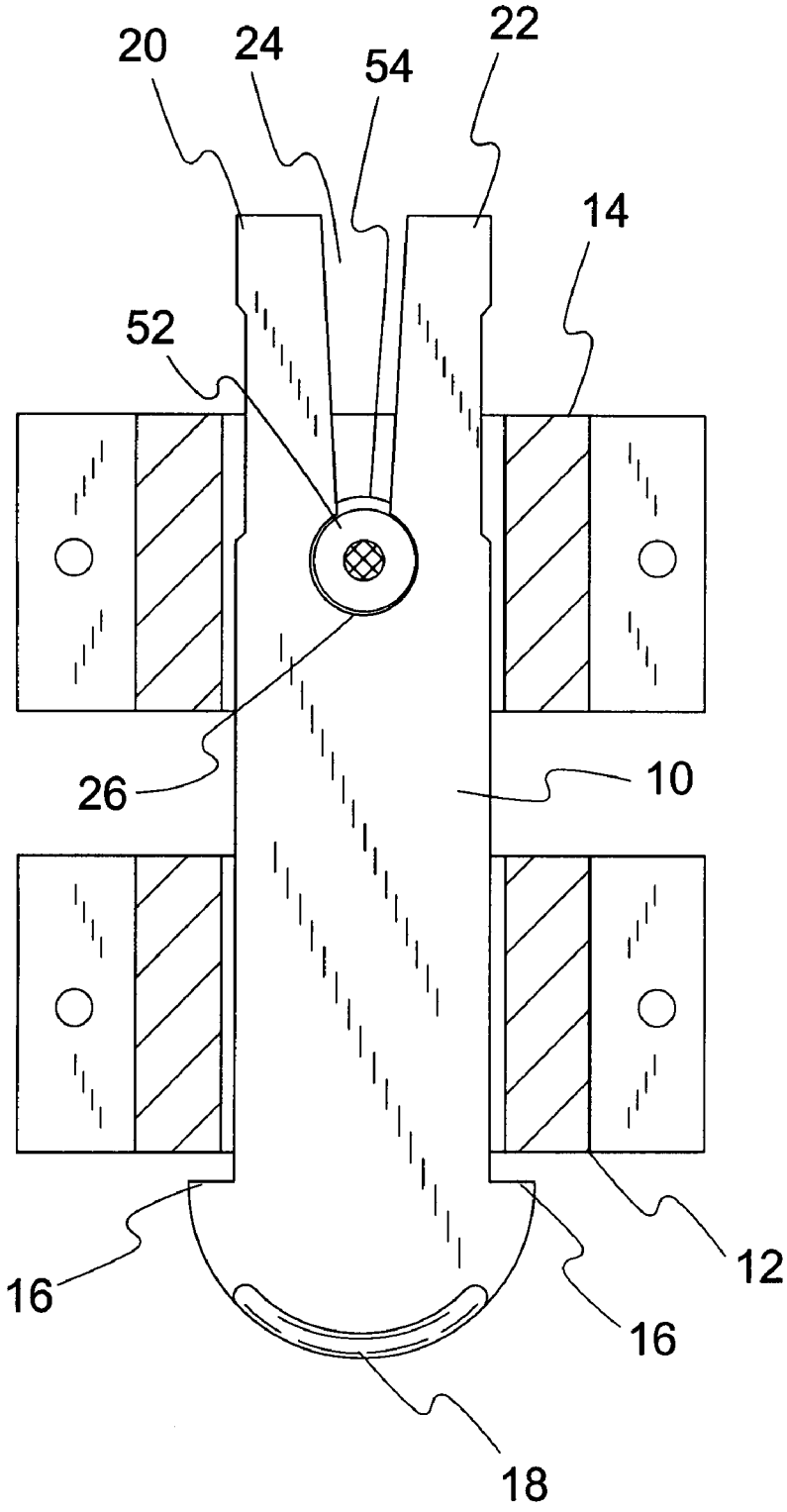
FIG. 7 is a view similar to FIG. 6, showing the bolt locked in the keeper.
Figure 8:
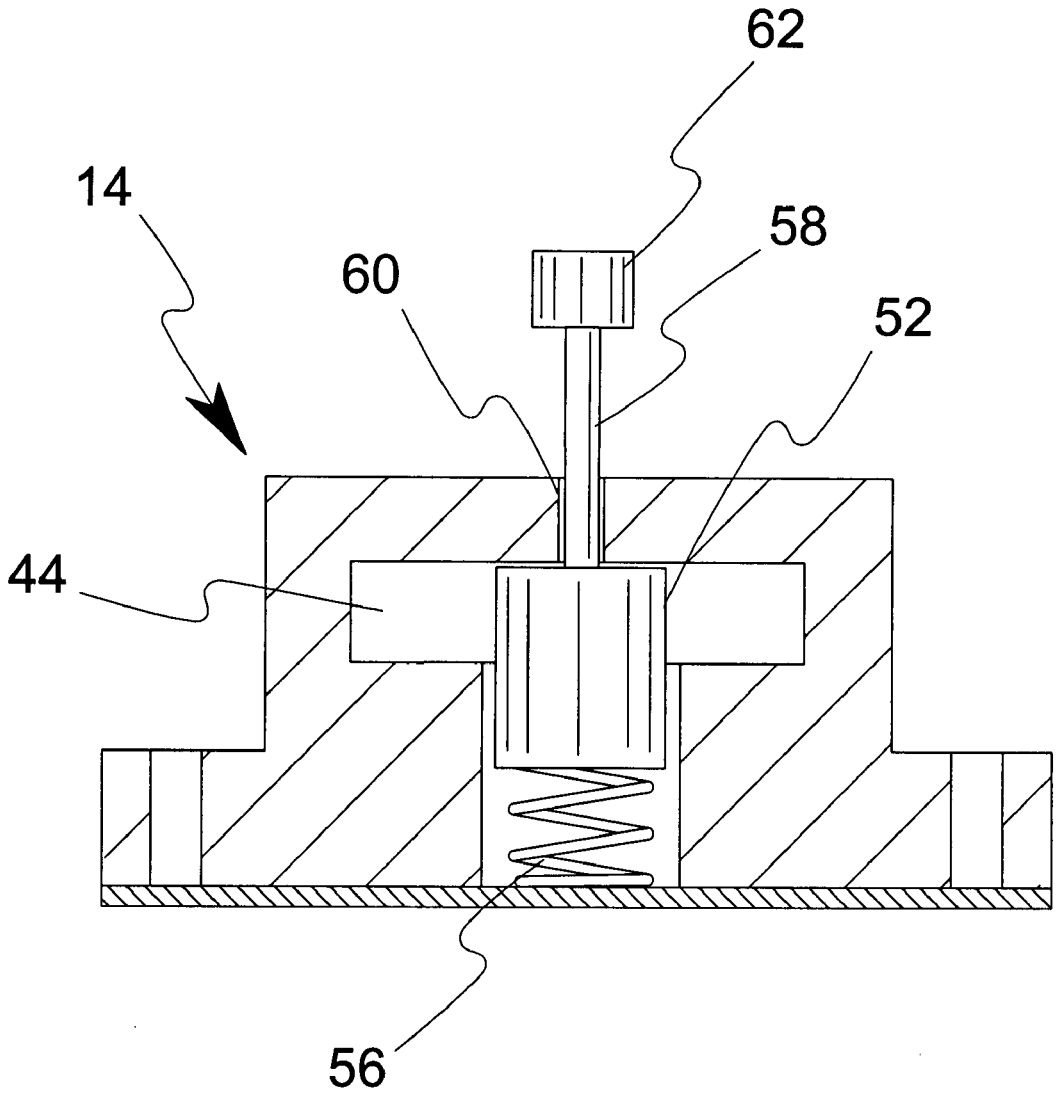
FIG. 8 is a view similar to FIG. 4, showing the plunger positioned to lock the bolt in the keeper.

FIGS. 7 and 8 show the slide plate locked into passageway 44 in keeper 14. The user has released finger pressure on button 62, allowing plunger head 52 to rise in response to the force exerted by spring 56. The plunger head 52 rises into passageway 44, to the top of the passageway, while also entering cavity 26. The plunger head is of a similar diameter to cavity 26 such that the plunger head can enter the cavity but cannot enter slot 24. Thus, the plunger head serves as a cross-bolt to lock the slide plate in a fixed position within keeper 14.

The assembled latching device can secure substantially any type of closure, including a complex closure. The slide plate is locked between the bolt housing 12 and keeper 14, regardless of how the secured closure is designed to move. The bolt housing can be attached to one side of a closure structure to be secured. The keeper is attached to the other side of the closure structure. By way of example and not limitation, these two sides may be a door and frame, two doors, a drawer and frame, or substantially any other type of closure structure.

Releasing the latch requires coordinated activity by two hands. Such coordinated activity typically is difficult for a small child. In this perspective, the latch is child-resistant. Releasing the latch is done by pushing button 62 sufficiently to overcome the force of spring 56 and to return the plunger head to a position below the passageway 44, as shown in FIGS. 4 and 6. While the button is suitably depressed, pulling on rib 18 retracts the slide plate 10 from the keeper 14.

The parts of the latch are subject to reasonable modification. Thus, the forgoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention.

The invention claimed is:

1. In a latch assembly formed of a bolt housing, a longitudinally elongated latch bar partially retained within a passageway of the bolt housing and longitudinally extendable therefrom, and a keeper having a reception passage for receiving an extending free end of the latch bar; wherein the free end of the latch bar is extendable from the bolt housing into the keeper, thereby establishing a latching relationship with the keeper, the improvement comprising:

the free end of said latch bar is configured with a cavity on a lateral face thereof, and the latch bar is forked from the free end of the latch bar to a junction with said cavity, thereby defining a longitudinal slot extending from the free end of the latch bar and leading into the bolt cavity;

the cavity is of a dimension wider than the width of said slot at its junction with the cavity;

said keeper comprises a cross-latch in a transversely moveable relationship with respect to said reception passage, between positions of greater and lesser intersection with the reception passage;

resilient means biases movement of said cross-latch toward a position of greater intersection with the reception passage;

an operator is connected to the cross-latch for selectively retracting the cross-latch against the force of said resilient means to a position of lesser intersection with the reception passage;

the latch bar comprises a keeper end stop, and said cross-latch is suitably positioned with respect to the reception passage to be engaged with said keeper end stop for stopping entry of said latch bar within the reception passage at a location where the cavity is positioned to receive the cross-latch when the cross-latch is in said position of lesser intersection with the reception passage;

wherein said cavity and cross-latch are suitably arranged such that the cross-latch and cavity are mutually engaged when the cross-latch is in said position of greater intersection with the reception passage and the latch bar is positioned in the reception passage to receive the cross-latch, thereby locking the latch bar to the keeper; and the cross-latch and cavity are mutually disengaged when the cross-latch is in said position of lesser intersection with the reception passage, allowing the latch bar to be inserted into or removed from the reception passage.

2. In the latch assembly of claim 1, the further improvement comprising:

said latch bar is configured as a plate of rectangular transverse profile; and said reception passage is configured with a matching rectangular profile for receiving the latch bar, such that the latch bar is substantially non-rotatable with respect to the reception passage and relative movement between the latch bar and the reception passage is substantially along a single longitudinal axis;

whereby, moving the latch bar along a single longitudinal axis establishes alignment between the cavity with the cross-latch.

3. In the latch assembly of claim 2, the further improvement comprising:

said latch bar carries a longitudinal rib of predetermined height on a major face thereof;

a matching channel in said keeper extends parallel to said reception passage and receives said rib;

said keeper end stop further comprises a keeper end of the rib that terminates at an edge of said cavity, longitudinally opposite from said slot; and in said position of lesser intersection with the reception passage, said cross-latch is interposed in said keeper channel such that said keeper end of the rib strikes a side of the cross-latch longitudinally opposite from said slot when the cross-latch and cavity are aligned for the cross-latch to enter the cavity.

4. In the latch assembly of claim 2, the further improvement comprising:

said bolt housing passageway is configured with a rectangular profile suitable to carry said latch bar in slidable relationship;

the latch bar carries a longitudinal rib of predetermined height on a major face thereof;

a matching channel in said bolt housing extends parallel to the bolt housing passageway and receives said rib;

said bolt housing channel includes a bolt housing channel base wall facing the rib and spaced from the bolt housing passageway by a greater dimension than said predetermined height of the rib;

whereby the latch bar is guided in said bolt housing on a major face in contact with the bolt housing passageway, suspending the rib at a gap from said bolt housing channel base.

5. In the latch assembly of claim 4, the further improvement comprising:

said rib carries a first stop extending from the rib toward said bolt housing channel base; and said bolt housing channel carries a second stop in an interfering position with respect to said first stop;

whereby the first and second stops prevent said latch bar from exiting said bolt housing in at least a first longitudinal direction of movement.

6. In a latch assembly formed of a bolt housing, a longitudinally elongated latch bar partially retained within a passageway of the bolt housing and longitudinally extendable therefrom, and a keeper having a reception passage for receiving an extending free end of the latch bar; wherein the free end of the latch bar is extendable from the bolt housing into the keeper, thereby establishing a latching relationship with the keeper, the improvement comprising:

said latch bar is configured as a plate of rectangular transverse profile, the free end of said latch bar is configured with a cavity on a lateral face thereof, and the latch bar carries a longitudinal rib of predetermined height on a major face thereof;

said bolt housing passageway is configured with a rectangular profile suitable to carry the latch bar in slidable relationship;

said bolt housing defines a channel matching said longitudinal rib of the latch bar, extending parallel to the bolt housing passageway, and receiving the longitudinal rib;

said bolt housing channel includes a bolt housing channel base wall facing the rib and spaced from the bolt housing passageway by a greater dimension than said predetermined height of the rib;

the rib carries a first stop extending from the rib toward said bolt housing channel base;

said bolt housing channel carries a second stop in an interfering position with respect to said first stop;

said keeper carries a cross-latch in a transversely moveable relationship with respect to said reception passage, between positions of greater and lesser intersection with the reception passage, wherein said reception passage is configured with a matching rectangular profile for receiving the latch bar, such that the latch bar is substantially non-rotatable with respect to the reception passage and relative movement between the latch bar and the reception passage is substantially along a single longitudinal axis;

resilient means biases movement of said cross-latch toward a position of greater intersection with the reception passage;

an operator is connected to the cross-latch for selectively retracting the cross-latch against the force of said resilient means to a position of lesser intersection with the reception passage;

wherein said cavity and cross-latch are suitably arranged such that the cross-latch and cavity are mutually engaged when the cross-latch is in said position of greater intersection with the reception passage and the free end of the latch bar has been sufficiently inserted into the reception passage, thereby locking the latch bar to the keeper;

the cross-latch and cavity are mutually disengaged when the cross-latch is in said position of lesser intersection with the reception passage, allowing the latch bar to be inserted into or removed from the reception passage; and whereby, moving the latch bar along a single longitudinal axis establishes alignment between the cavity with the cross-latch, and the latch bar is guided in said bolt housing on a major face in contact with the bolt housing passageway, suspending the rib at a gap from said bolt housing channel base; and the first and second stops prevent said latch bar from exiting said bolt housing in at least a first longitudinal direction of movement.

* * * * *